US008186128B2

(12) United States Patent
Way

(10) Patent No.: US 8,186,128 B2
(45) **Date of Patent: *May 29, 2012**

(54) MULTI-STOREY INSULATED CONCRETE FOAM BUILDING

(76) Inventor: Alven J. Way, Waterloo (CA)

( * ) Notice: Subject to any disclaimer, the term of this patent is extended or adjusted under 35 U.S.C. 154(b) by 1293 days.

This patent is subject to a terminal disclaimer.

(21) Appl. No.: 11/074,788

(22) Filed: Mar. 9, 2005

(65) Prior Publication Data

US 2005/0210785 A1 Sep. 29, 2005

(51) Int. Cl.
*E04B 1/00* (2006.01)

(52) U.S. Cl. .... 52/742.14; 52/236.6; 52/259; 52/745.09

(58) Field of Classification Search ..... 52/251, 52/259, 236.6, 236.8, 426, 431, 562, 565, 52/742.14, 745.1, 745.09, 266, 264, 741.14, 52/741.13, 295, 745.05

See application file for complete search history.

(56) References Cited

U.S. PATENT DOCUMENTS

| | | | | | |
|---|---|---|---|---|---|
| 377,940 | A | * | 2/1888 | Hevner | 52/745.09 |
| 791,875 | A | * | 6/1905 | Buente | 52/259 |
| 2,053,873 | A | * | 9/1936 | Niederhofer | 52/213 |
| 2,204,583 | A | * | 6/1940 | Falls | 52/302.3 |
| 3,538,654 | A | * | 11/1970 | Gerola | 52/97 |
| 3,645,056 | A | * | 2/1972 | Gerola | 52/259 |
| 3,691,708 | A | * | 9/1972 | Firnkas | 52/470 |
| 4,125,981 | A | * | 11/1978 | MacLeod et al. | 52/309.12 |
| 4,133,156 | A | * | 1/1979 | Unger | 52/383 |
| 4,290,246 | A | * | 9/1981 | Hilsey | 52/169.1 |
| 4,338,759 | A | * | 7/1982 | Swerdlow et al. | 52/742.14 |
| 4,616,459 | A | * | 10/1986 | Shubow | 52/309.12 |
| 4,669,240 | A | * | 6/1987 | Amormino | 52/236.6 |
| 4,731,971 | A | * | 3/1988 | Terkl | 52/742.14 |
| 4,864,792 | A | * | 9/1989 | Andre et al. | 52/426 |
| 4,924,641 | A | | 5/1990 | Gibbar et al. | |
| 4,998,393 | A | * | 3/1991 | Baena | 52/236.9 |
| 5,038,541 | A | | 8/1991 | Gibbar, Jr. | |
| 5,107,648 | A | | 4/1992 | Roby | |
| 5,163,263 | A | * | 11/1992 | DeSchutter et al. | 52/742.14 |
| 5,479,749 | A | * | 1/1996 | Colasanto et al. | 52/236.9 |
| 5,488,806 | A | | 2/1996 | Melnick et al. | |
| 5,570,550 | A | | 11/1996 | Roby | |
| 5,657,600 | A | | 8/1997 | Mensen | |
| 5,669,194 | A | * | 9/1997 | Colasanto et al. | 52/236.8 |
| 5,809,727 | A | | 9/1998 | Mensen | |

(Continued)

FOREIGN PATENT DOCUMENTS

CA 1283793 C 5/1991

(Continued)

OTHER PUBLICATIONS

Excerpt from a 1969 textbook, "Modern Carpentry" by Willis H. Wagner.

(Continued)

*Primary Examiner* — Basil Katcheves
*Assistant Examiner* — Beth Stephan
(74) *Attorney, Agent, or Firm* — Dimock Stratton LLP; Etienne de Villiers

(57) ABSTRACT

Multi-storey ICF building having concrete walls poured into insulated concrete forms with adjustments mounted between floors and an outside foam layer and guides for an inside for layer. ICF buildings can be constructed with greater than three stories and masonry or stucco exteriors without the use of supplementary forms.

18 Claims, 11 Drawing Sheets

U.S. PATENT DOCUMENTS

| | | | | |
|---|---|---|---|---|
| 6,018,922 | A * | 2/2000 | McKinnon | 52/700 |
| 6,438,918 | B2 | 8/2002 | Moore, Jr. et al. | |
| 6,481,178 | B2 | 11/2002 | Moore, Jr. et al. | |
| 2002/0017070 | A1 | 2/2002 | Batch | |
| 2002/0100247 | A1 * | 8/2002 | Lai | 52/742.14 |

FOREIGN PATENT DOCUMENTS

| | | | |
|---|---|---|---|
| CA | 2104471 | A1 | 9/1992 |
| CA | 1312477 | C | 1/1993 |
| CA | 1314727 | C | 3/1993 |
| CA | 1326769 | C | 2/1994 |
| CA | 2204558 | A1 | 12/1997 |
| CA | 2315638 | A1 | 7/1999 |
| CA | 2382279 | A1 | 3/2001 |
| CA | 2399300 | A1 | 10/2001 |
| CA | 2343609 | A1 | 3/2002 |
| CA | 2512221 | A1 | 7/2004 |
| CA | 2566545 | A1 | 9/2005 |
| CA | 2566566 | A1 | 9/2005 |
| CA | 2499971 | C | 1/2007 |

OTHER PUBLICATIONS

Drawing provided by Sto Corporation, dated Jun. 2003.
Quad Lock Building Systems Ltd. dated Nov. 8, 2003.
Technical documentation of Arxx Building Products dated Oct. 2000.

* cited by examiner

MULTI-STOREY INSULATED CONCRETE FOAM BUILDING

BACKGROUND OF THE INVENTION

1. Field of the Invention

This invention relates to a multi-storey building and a method of construction thereof wherein the building is constructed using insulated concrete forms. More particularly, this invention relates to buildings exceeding three stories.

2. Description of the Prior Art

Insulated concrete form (ICF) buildings have generally not been constructed with more than three stories because the building code requirements cannot be met in a cost effective manner. Also, great difficulty has been encountered in keeping the ICF walls sufficiently straight. As can be appreciated, it is difficult to keep the ICF walls straight as the concrete is being poured because the foam walls of the forms are lightweight and are preferably not supported by external supports. With some ICF buildings, the foam walls are supported by supplementary supports to keep the walls reasonably straight while the concrete is poured. The supplementary supports are located against the outer side surfaces of the inside and outside foam layers and are usually anchored to the ground. For example plywood supplementary supports are held against the outer side surfaces of the foam layers by wooden boards (e.g. 2×4's) that are anchored on the ground and extend at an angle. After the concrete has set, the supplementary supports, which are used on both the outside and inside foam walls, are removed. Also, the concrete is extremely heavy compared to the weight of the forms. For buildings of three stories or less, if the first wall for example, is not straight within a particular narrow tolerance, then the wall for the second storey will be more out of line and the wall for the third storey will be even further out of line. As can be appreciated, if there are four stories or eight stories or more in the building, the mistakes made on the lower floors are compounded to a point where the walls on the upper stories would be noticeably out of line. Supplementary supports are expensive and time consuming to install and remove. Also, supplementary supports are even more expensive and labour intensive on upper storeys of multi-storey buildings. For example, in some ICF buildings, the first storey of foam forms are supported inside and outside by supplementary supports that are anchored in the ground and extend at an angle to the foam forms. It is not cost effective to have removable supplementary supports in high rise buildings. It is not feasible to use supplementary forms that extend up from the ground in buildings exceeding three stories. It is extremely expensive, if not impossible, to correct an upper storey ICF wall on a high-rise building that is out of line. Repairs must be made to the outside surface of the misaligned wall from the outside of the building. Often an outer portion of the concrete wall must be removed in an attempt to straighten the wall as much as possible.

ICF buildings can be constructed having a masonry exterior. However, since the forms themselves are very expensive compared to other concrete forms, it becomes extremely expensive to add a masonry or brick exterior to an ICF building. ICF buildings can be cost competitive when the exterior surface of the building is a type of stucco. Many jurisdictions have fire regulations that become more stringent when buildings exceed three stories. In the Province of Ontario, Canada, for example, there is a building code requirement that provides that exterior cladding on a building must remain in place for the minimum time required by the code from the commencement of the fire. The purpose of this regulation is to prevent the exterior cladding of the building from falling onto people who are attempting to escape from the building or from falling onto fire personnel. With ICF buildings completed with a stucco exterior, the exterior foam layer can fall off the building during a fire. If a building will not meet the fire regulations in the jurisdiction where the building is to be constructed, no building permit will be issued. Further, insurers are not willing to insure any building that does satisfy all of the fire regulations.

Insulated concrete forms are known. The form walls are separated by a predetermined distance by ties that are embedded in the foam. Most forms are designed to construct vertical walls at a 90° angle relative to one another. Some forms are angled to construct walls at a 45° angle to one another. Other forms are curved to allow curved walls to be constructed. Forms are specifically designed for use as corner forms. One ICF manufacturer is Nudura (a trademark). The Nudura forms have hinged ties so that the parallel foam walls can be collapsed together during transport and separated during use. The Nudura forms have a standard size of 8 feet by 1.5 feet and are made from expanded polystyrene foam with hinged polypropylene ties. The polystyrene foam is stated to have a density of 1.26 lbs/ft$^3$, a flame spread index of less than 75 and a maximum smoke development index of less than 450 when tested under UL723. Nudura and other manufacturers produce numerous accessory forms. Insulated concrete forms can provide the formwork for foundation and basement load bearing walls and interior or exterior load bearing walls. Of course, ICF can be used on non-load bearing walls as well.

While it is common to construct ICF buildings up to three stories, buildings beyond three stories have generally not been constructed using insulated concrete forms. Free standing ICF buildings beyond three stories have not been constructed previously. An advantage of having an ICF building is that the completed building has a monolithic poured concrete wall installed between the two foam layers of the insulated concrete forms. Voids within the concrete are removed using agitators just after the concrete is poured. The foam layers provide the insulation for the building. Thus, the building is solidly constructed and it is well insulated making it less expensive to heat in the winter and less expensive to aircondition in the summer. The disadvantage is that the insulated concrete forms themselves are expensive relative to other types of construction.

SUMMARY OF THE INVENTION

It is an object to the invention to provide a multi-storey ICF building and a method of construction thereof that can be suitably used for high-rises or building exceeding three stories or for any multi-storey building. It is a further object of the present invention to provide an ICF building and a method of construction thereof where the building satisfies all of the fire regulations for buildings exceeding three stories. It is a further object of the present invention to provide a multi-storey ICF building and a method of construction thereof where no removable supplementary supports are required on the outside of the sides of the foam layers for the insulated concrete forms to keep the walls straight while the concrete is poured, the supplementary supports being removed after the concrete sets. It is still a further object of the present invention to provide a multi-storey ICF building where the outside foam layer is periodically straightened and supported by supports that extend inward from the outside foam layer where there is no corresponding inside layer opposed to the outside layer and the supports are anchored directly or indirectly in the wall that has been previously formed. It is a further object of the present invention to provide a multi-storey ICF building and a method of construction thereof using guides at the beginning of each storey for the inside foam layer of the ICF forms, the guides for each storey being vertically aligned with one another.

A method of constructing a multi-storey building having at least one vertical wall made of insulated concrete forms uses forms each having two layers of foam spaced apart from one another by ties to define a core, said building to have multiple floors with ends that are embedded in said at least one vertical wall, said core to be filled with concrete except for openings through windows and doors, an uppermost row of forms of each storey having at least part of an outside foam layer with no corresponding inside foam layer to allow each floor to be partially embedded into said wall, said method comprising stacking said forms to form a vertical wall for one storey at a time with suitable openings for windows and doors, installing reinforcing rods, pouring concrete to fill said core substantially up to a top of said inside foam layer of said uppermost row of forms, installing supports that are affixed directly or indirectly to a portion of said concrete wall that has previously been poured to straighten and support said outside foam layer of said uppermost row of forms.

A method of constructing a building having multiple stores uses insulated concrete forms, said forms usually having two opposing layers of foam space apart from one another by ties to define a core. Each of the forms has an inside foam layer and an outside foam layer, the forms being stackable to form a vertical wall with at least part of an uppermost row of forms of each storey having an unopposed outside foam layer. The unopposed outside foam layer being at a higher level than an inside foam layer. The method comprises stacking said forms for an insulated concrete form storey with openings for any windows and doors, with at least part of said uppermost row of forms for each storey having an unopposed outside foam layer with said top being higher than a top of said inside foam layer for each storey, installing reinforcing rods and filling said core with fresh concrete substantially up to said top of said inside foam layer of said uppermost row of forms, allowing said concrete to cure sufficiently to enable said floor to be installed, installing supports to straighten and support said unopposed outside foam layer, said supports extending inward from said unopposed outside foam layer and being anchored directly or indirectly in said wall as previously formed, installing said floor and repeating said method for each subsequent storey, at least partially embedding said supports in said concrete and locating said supports to leave said supports in place when said vertical wall has been completed.

A method of constructing a building having multiple stories uses a plurality of insulated concrete forms. Each of the forms has two layers of foam spaced apart from one another by a predetermined distance to define a core. The two layers are an inside layer and an outside layer. The building has a base and the forms are stackable to form a wall. The method comprises constructing the building in stages on the base, arranging the forms on the base and stacking the forms to form a vertical wall for a first insulated concrete foam storey with openings for any windows and doors, cutting away the inside layer of each form that is located just beneath a floor for a second storey, thereby creating cut forms. The method further includes installing reinforcing rods and filling the core with fresh concrete, removing voids and allowing the fresh concrete to cure, installing a floor for the second storey just above a cut line of the cut forms in such a manner that the floor can be partially embedded into the vertical wall, installing a plurality of adjustments between the floor for the second storey and the outside foam layer of the cut forms to allow the outside foam layer to be straightened, adjusting the adjustments to straighten and support the outside foam layer, stacking forms on the cut forms and the floor directly above the forms for the first storey with suitable openings for any doors and windows and installing reinforcing rods, and repeating the method described for the first insulated concrete form storey for subsequent stories and installing a roof on an uppermost storey.

A method of constructing a building having multiple stories using insulated concrete forms having two parallel foam layers separated by ties that are embedded in the foam layers to define a core for receiving poured concrete, the forms being stackable to form a wall or walls, a method comprising:

(a) constructing a base for the walls;
(b) stacking forms on the base to form the walls one storey at a time with suitable openings for doors and windows;
(c) removing part of an inside foam layer of an upper level of forms for each storey to allow a floor to be embedded into the wall, thereby creating a row of cut forms at a cut level for each floor;
(d) installing frames for the windows and doors as the forms are stacked;
(e) installing reinforcing rods in the walls;
(f) filling the core with fresh concrete up to the cut level just below a lower surface of a floor to be installed and removing voids in said concrete;
(g) allowing the concrete to cure sufficiently to allow the floor to be installed and installing the floor;
(h) installing a plurality of adjustments along the cut forms between the floor and the outside foam layer of the cut forms to allow the outside form layer to be supported and straightened, adjusting the adjustments to straighten and support the outside form layer;
(i) stacking forms on the cut forms and on the floor directly above the forms located in the storey beneath the storey that is being constructed to form a subsequent storey with suitable openings for doors and windows while installing frames for any doors and windows;
(j) repeating steps (c) to (i) for each subsequent storey except for an upper most storey;
(k) constructing said upper most storey and installing a roof on said upper most storey.

A method of constructing a building using a plurality of insulated concrete forms, each of the forms having two layers of foam spaced apart from one another by a predetermined distance to define a core, said two layers having an inside layer and an outside layer, the buildings having a base, the forms being stackable to form a vertical wall with openings for windows and doors therein, the method comprising constructing the building in stages on the base, arranging the forms on the base and stacking the forms to form a vertical wall with openings for any windows and doors, installing a frame for each window and door, installing retention means on an exterior surface on each frame in such a manner that the retention means is embedded in concrete when concrete is poured, installing mesh on an exterior surface of each frame in such a manner that the mesh is embedded in concrete when the concrete is poured, the mesh being wide enough to extend along an exterior of the frame along the outside foam layer and partially along the front of the outside foam layer, installing each frame containing retention means and the mesh before the forms are stacked around each frame, pouring the concrete to fill the core and finishing an exterior surface of the building by embedding an exterior section of mesh in a stucco mixture on the exterior surface.

Preferably, the method includes the steps of constructing the building until the building is greater than three storeys.

A multi-storey building has exterior vertical walls formed using a plurality of insulated concrete forms, the forms each having two layers of foam spaced apart from one another by a pre-determined distance to form a core. The vertical walls include doors and windows. The building comprises a guide for an inside foam layer of said forms located on a floor for each storey. The building has floors embedded in the vertical walls, the forms having part of the inside foam layer that is cut away at a cut level for each floor that is embedded in the vertical wall to create cut forms, with adjustments extending between each floor and an outside foam layer of the cut forms. The core is filled with concrete and the adjustments extend through the concrete at each floor that is embedded in the vertical wall.

Preferably, the guide is a track.

A multi-storey building has vertical walls formed using a plurality of insulated concrete forms. The forms each have two layers of foam spaced apart from one another by a pre-determined distance to form a core for receiving fresh concrete. The vertical walls include doors and windows and the building has a guide for an inside foam layer of the two layers of the two layers of the forms located at an upper surface of a floor of each storey.

A multi-storey building has vertical walls formed using a plurality of insulated concrete forms, the forms each having two layers of foam spaced apart from one another by a pre-determined distance to form a core. The vertical walls include doors and windows. The building comprises floors embedded in the vertical walls. Each form has an inside foam layer and an outside foam layer comprising the two layers of foam. The forms have part of the inside foam layer cut away at a cut level to form cut forms for each floor that is embedded in the vertical wall with adjustments extending between the floor and the outside layers of the cut forms. The core is filled with concrete and the adjustments extend through the concrete in each floor that is embedded in the vertical wall.

Preferably, the building is greater than three storeys.

A multi-storey building has vertical walls formed using a plurality of insulated concrete forms, the forms each having two layers of foam as spaced apart from one another by ties to form a core. The vertical walls include openings for doors and windows. The building comprises a guide for an inside foam layer of the forms located on a floor for each storey, the building having floors embedded in the vertical walls. The forms have a channel located at an uppermost level of each storey that is embedded in the wall at each channel, the core containing reinforcing rods. The core is filled with concrete with supports extending directly or indirectly between the concrete and the outside foam layer at each channel. The supports are at least partially embedded in the vertical wall.

A multi-storey building has vertical walls formed using a plurality of insulated concrete forms. The forms each have two layers of foam spaced apart from one another by a pre-determined distance to form a core therebetween. The vertical walls include openings for doors and windows with frames thereon. The frames for the windows are constructed of foam pieces that are inserted between the two layers of foam and held in place by adhesive.

A multi-storey building has vertical walls formed using a plurality of insulated concrete forms. The forms each have two layers of foam spaced apart from one another by a pre-determined distance to form a core therebetween. The vertical walls include openings for doors and windows having frames thereon. The building comprises retention means located in an exterior surface of each frame in such a manner that the retention means is embedded in concrete when the concrete is poured. A mesh is located on an outer surface of each frame in such a manner that the mesh is embedded in concrete when the concrete is poured. The mesh is wide enough to extend along an outside of the frame around the outside foam layer and partially along a front of the exterior foam layer. The concrete fills the core, the mesh having an interior section that is embedded in the concrete and an exterior section that is embedded in a stucco mixture.

A method of constructing a multi-storey building has at least one vertical wall made of insulated concrete forms, said forms each having two layers of foam spaced apart from one another by ties to define a core. The two layers of foam are an inside foam layer and an outside foam layer. The building is to have multiple floors with ends that are embedded in the at least one vertical wall. The core is to be filled with concrete except for openings for windows and doors. The method comprises installing an alignment guide for the inside foam layer on an upper surface of each floor for each storey. There are a plurality of alignment guides, said guides being vertically aligned with one another for each wall of the at least one vertical wall.

A method of constructing a multi-storey building uses at least one vertical wall made of insulated concrete forms. The forms each have two layers of foam spaced apart from one another by ties to define a core, said two layers of foam being an inside foam layer and an outside foam layer. The building is to have a stucco exterior with the core to be filled with concrete except for openings for windows and doors. There are frames around an outside of the windows and doors with retention means extending beyond an outer surface of each frame. The method comprises installing the retention means to extend from the core to an outside of the frame around the outside foam layer and partially along a front of the outside foam layer, embedding an inner portion of the retention means in concrete poured into the core, and embedding an outer portion of the retention means in a stucco mixture when installing stucco on the building.

Preferably, the building exceeds three storeys.

DETAILED DESCRIPTION OF PREFERRED EMBODIMENT

The present invention can be used with insulated concrete forms of various manufacturers and is not in any way restricted to Nudura forms. The forms must have sufficiently strong ties to hold the two foam layers together and a high enough density and chemical formula to meet the fire requirements. Various types of insulated concrete forms can be used on the same building. For example, the forms can be straight forms where the two foam layers are flat and are rectangles of substantially the same size. The forms can be curved forms for forming a curved wall. When curved forms are used, the inner foam layer will be smaller than the outer foam layer simply because the inside of a curve is a shorter distance than an outside of a curve. Corner forms can be used where the outside foam layer has a 90° angle and the inside foam layer has a corresponding 90° angle. The inside foam layer will be smaller than the outside foam layer to compensate for the difference in distance around the outside of a corner compared to the inside of a corner of a corner form. Angled forms can also be used. Angled forms, for example, will be similar to corner forms except that the angle between the two planes of the form would not be 90°. The angled forms could be 45° in order to construct a wall that is at an angle of 45° to another wall. Special forms can also be used. Special forms can have, for example, unique shapes for specific purposes. Also, the forms can be supplied as components of forms that are assembled on site. The forms can also be non-symmetrical forms where the inside foam layer does not correspond to the outside foam layer. For example, the inside foam layer can have a shorter height than the outside foam layer of the same form. Forms of any of the types described can be cut on site to fit the particular location where the form is to be installed.

Figure 1:
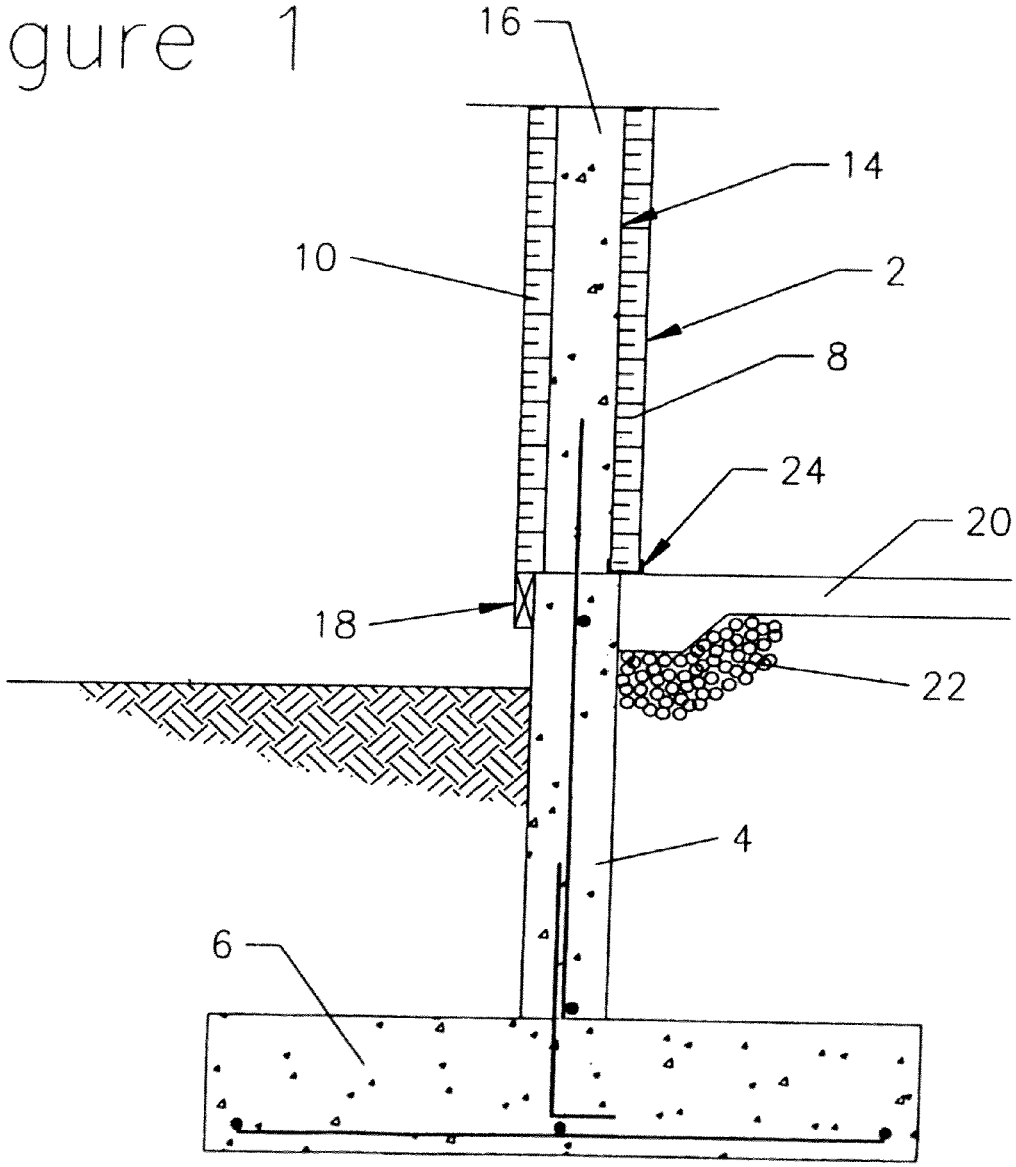
FIG. 1 is a schematic end view of a vertical wall using ICF construction.

In FIG. 1, there is shown an end view of an ICF exterior wall 2 that forms part of a building. The ICF wall 2 is constructed on a foundation 4, which in turn is constructed on a footing 6. The ICF wall 2 has an inside foam layer 8 and an outside foam layer 10. Each insulated concrete form has two parallel foam layers separated by a pre-determined distance that defines a core 14 between the two layers. The core 14 is filled with poured concrete 16. It can be seen that a lower edge of the outside foam layer 10 is supported by a wood support 18 that is attached to the outside of the foundation 4. The wood support 18 can be left in place after the concrete cures, but is preferably removed. The wood support 18 is not used where the ICF wall is constructed directly on the footing 6. The wood support is not essential, but is preferred to provide the maximum interior space for a particular foundation wall and to have the outside foam layer extend outward beyond the foundation wall so that water on the outside foam layer will be outside the foundation wall. If the ICF forms are moved slightly inward from the position shown in FIG. 1, the wood support 18 can be eliminated. Inside the building, there is a finished floor 20 constructed on a stone base 22. In this particular building, there is no basement and the floor 20 is constructed directly on the stone base 22, which is, in turn, constructed on grade. The inside foam insulated layer 8 is constructed on a guide 24, which is located on the floor 20. The insulated concrete form wall can be installed directly on the footing or a building can be constructed having a full or partial basement where the ICF wall is formed on top of a foundation wall. Further, in some buildings, it might be desirable to have all or part of one or more walls constructed in a conventional manner without the use of ICF construction while another wall or walls are constructed using ICF construction.

Figure 2:
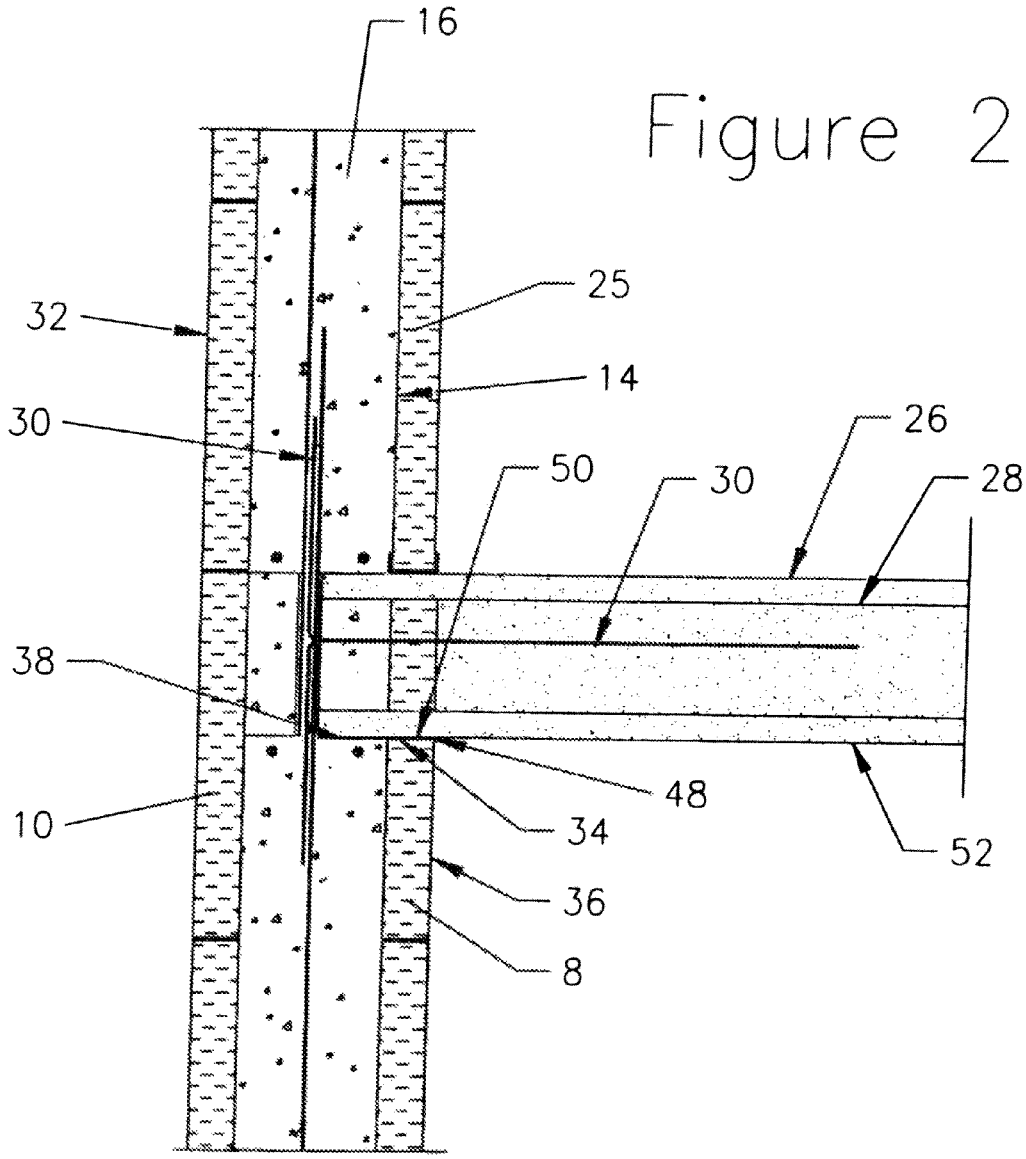
FIG. 2 is a schematic end view of a floor embedded in a sidewall of an ICF building.

In FIG. 2, there is shown a schematic side view of a side wall 25 of a building having a floor 26 partially embedded in the wall 25. Preferably, the floor 26 is a precast concrete slab 28 having a series of channels (not shown in FIG. 2) extending therein to allow for wiring and other connections to be made. It can be seen that reinforcing rods 30 are located in the core 14 of the wall 25 and also extend into the grout joint between two adjacent slabs 28 (only one of which is shown). Each form has the inside foam layer 8 and the outside foam layer 10. The forms 32 are stacked on top of one another and at the location of the floor 26 the inside foam layer is partially cut away at cut line 34 to allow the floor 26 to be embedded into the vertical wall. The partially cut away portion makes this row of forms (only one of which is shown) a row of cut forms 36.

Preferably, in constructing a building, the insulated concrete forms are stacked and arranged on the base of the building in such a manner that the building can be constructed one storey at a time. The forms are placed on the base and stacked up to the level where the floor of the second storey is to be installed. The forms along the top of the first storey are then partially cut away to create the cut forms 36 as shown in FIG. 2. Freshly poured concrete is then installed up to the level of the cut line 34. Agitators (not shown) are used to remove voids from the fresh concrete. The agitators are conventional and are not further described. The concrete is then allowed to cure sufficiently to support the weight of the floor slab 28. A bearing pad 38, preferably made from masonite, is inserted on top of the concrete as shown in the enlarged portion of FIG. 2. The floor 26 is then installed as shown to rest on the bearing pad 38. The slab 28 has a rigid insulation disk 40 aligned with each channel (not shown) of the floor slab. The insulation disk insulates the air within the channel in the interior of the building from the outside wall.

Figure 3:
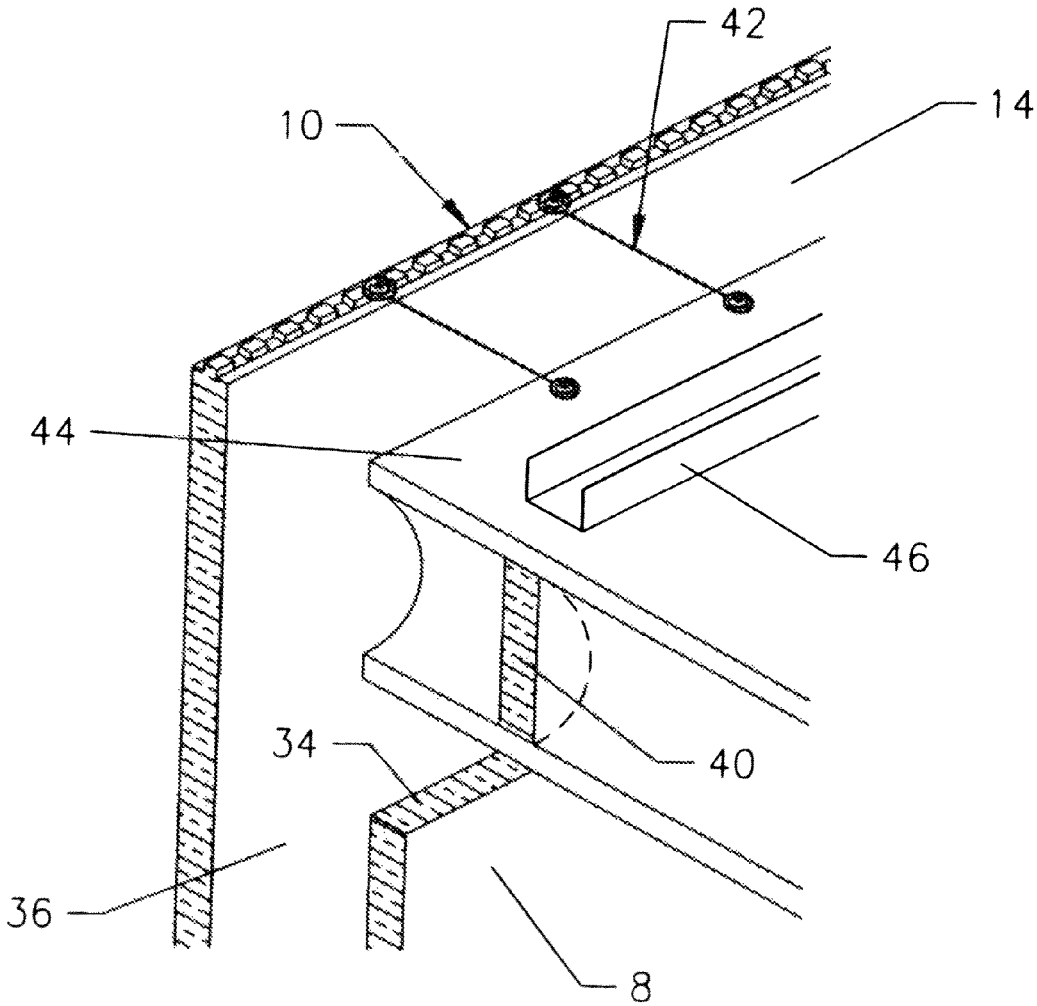
FIG. 3 is a partial perspective view of supports extending between a floor and an exterior foam layer of an uppermost row of forms of a storey.

As shown in FIG. 3, a support in the form of an adjustment 42 is installed between an upper surface 44 of the floor 26 and the outside foam layer 10 of the cut forms 36. The adjustment is preferably a wire tie or a plastic zip tie, but various types of ties will be suitable. There are a plurality of adjustments 42 that are adjusted longitudinally to straighten and support the outside foam layer 10 of the cut forms 36. A guide 46 is installed on top of the floor 26. The guide 46 is located directly above the guide 24 (see FIG. 1) for the inside foam layer 8 for the storey located immediately beneath the floor 26. Preferably, the guide is a track that is sized and shaped to receive the inside foam layers. Preferably, there is a guide for each vertical wall on the floor for each storey, the guides being vertically aligned with one another for each vertical wall.

Insulated concrete forms 32 (not shown in FIG. 3) are then placed and stacked above the floor 26 up to the next storey and reinforcing rods are installed within the core 14. The method just described for the first storey and second storey floor 26 is then repeated for each of the subsequent stories and floors until the vertical walls for all of the stories have been completed and a roof is installed on the uppermost storey. Foam 48 is inserted into a gap 50 between a lower surface 52 of the floor 26 and the cut line 34 (see FIG. 2). The gap 50 is created by the bearing pad 38.

Instead of cutting the forms on site or installing the forms on site and then cutting them, non-symmetrical forms can be manufactured for use as the uppermost foam layer of each storey where the inside foam layer is shorter than the outside foam layer by a distance that is substantially equal to the thickness of a floor to be installed at the top of that storey. These non-symmetrical forms can be manufactured in that manner or can be supplied as components to be assembled at the site. When the forms are cut on site, the inside foam layer is cut away and much of that foam layer is wasted. That waste can be eliminated by manufacturing the forms with the lower height inside foam layer, but non-symmetrical forms are also more expensive than straight forms because they are not produced in the same quantity.

Figure 4:
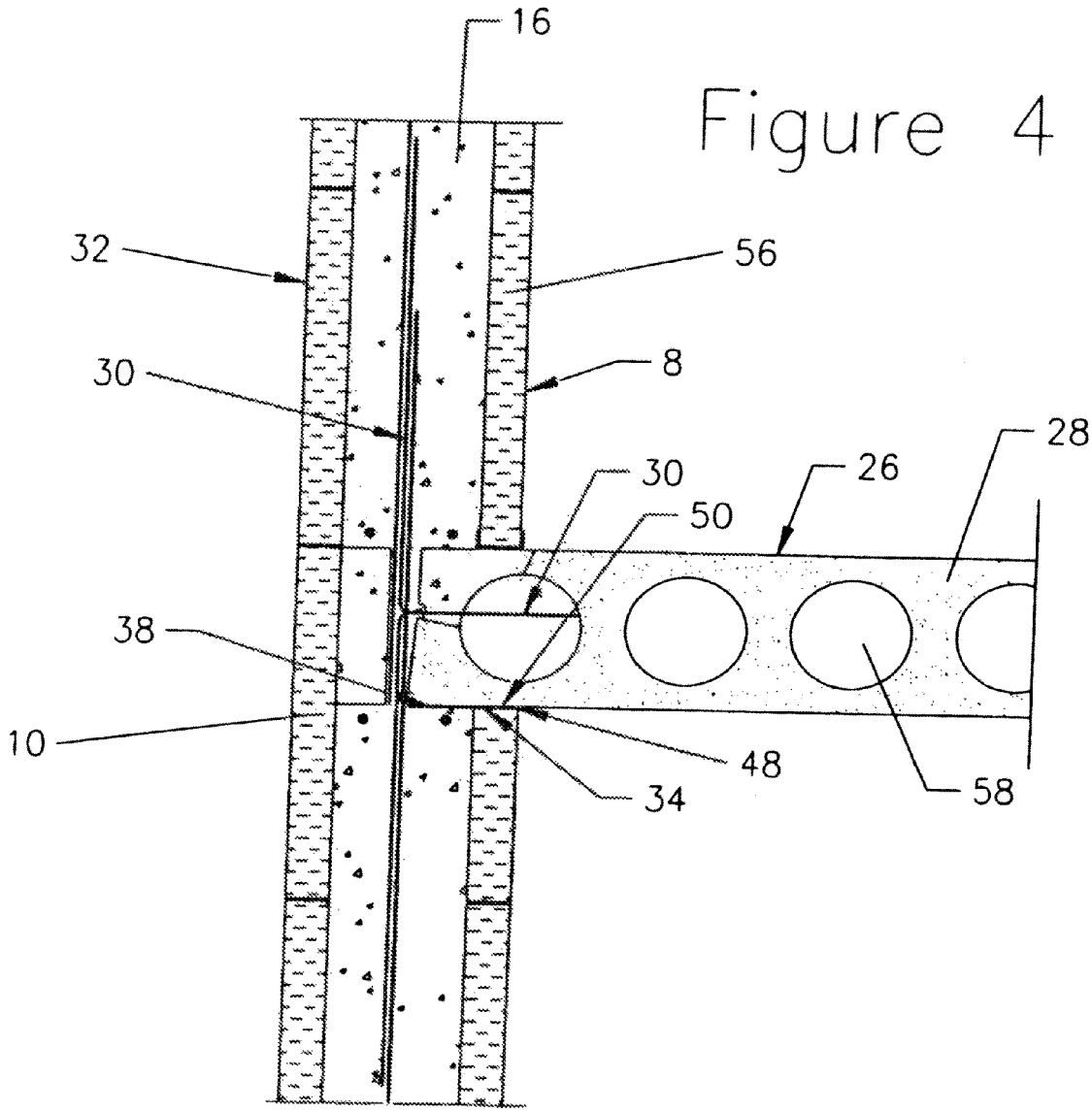
FIG. 4 is a schematic end view of a floor embedded in an end wall of an ICF building.

In FIG. 4, there is shown a vertical end wall 56. It can be seen that the floor 26 is formed of the precast concrete slab 28 with longitudinal channels 58 extending therein. Reinforcing rods 30 extend from the core 14 into one or more of the channels 58. The method of installing the floor 26 into the vertical end wall 56 is essentially the same as the method of installing the floor 26 into the sidewall 25. The same reference numerals are used in FIG. 3 to describe those components that are identical to the components of FIG. 2. The adjustments 42 shown in FIG. 3 are also installed between the upper surface 44 of the floor 26 and the outside foam layer 10 of the cut forms 36.

From FIGS. 1, 2, 3 and 4, it can be seen that there are no supplementary supports on the ICF wall. The ICF wall is free standing and the forms are supported only by the wooden support 18, the guides 24, 46 and the supports provided by the adjustments 42. All of these supports are provided by that part of the wall or building already constructed and are not supplementary supports.

Figure 5:
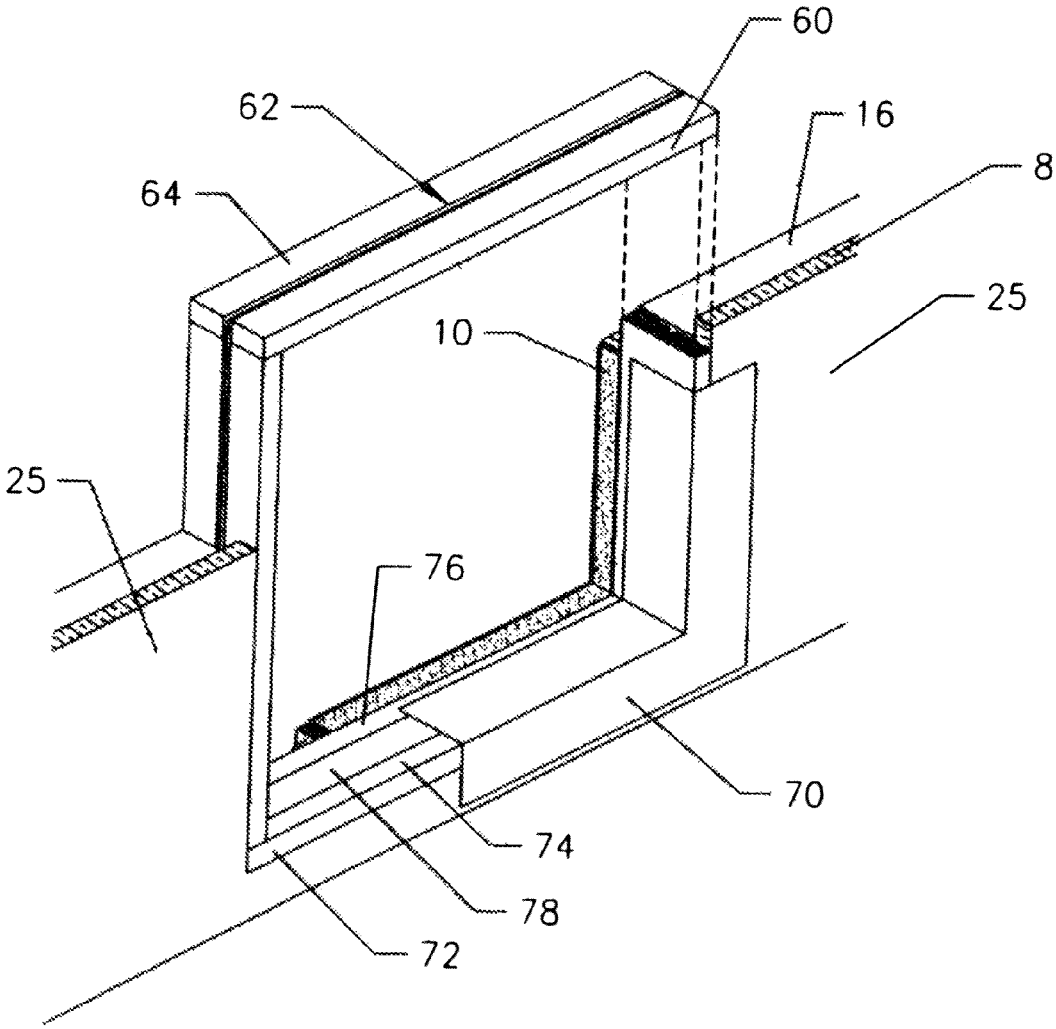
FIG. 5 is a partial perspective view of a window frame partially installed in an ICF wall.

In FIG. 5, there is shown a window frame 60 that is partially installed in an ICF exterior wall 25. The same type of frame (with a different size and usually a floor at a base) would be used for a door. A groove 62 extends longitudinally along an outer surface 64 of the frame 60. The purpose of groove 62 is to receive the freshly poured concrete within the core relative to the frame and thereby better secure the frame in the concrete wall. FIG. 5 is a partial perspective view from an interior of the building. The same reference numerals are used in FIG. 5 as those used in the previous figures to describe those components that are identical. A peel and stick membrane 70 prevents moisture from getting inside the frame and is affixed to the inside foam layer 8 around the window (or other openings). A bottom 72 of the frame 60 has an interior portion 74 and exterior portion 76 with a gap (not shown) between the portions filled with foam 78.

Figure 6:
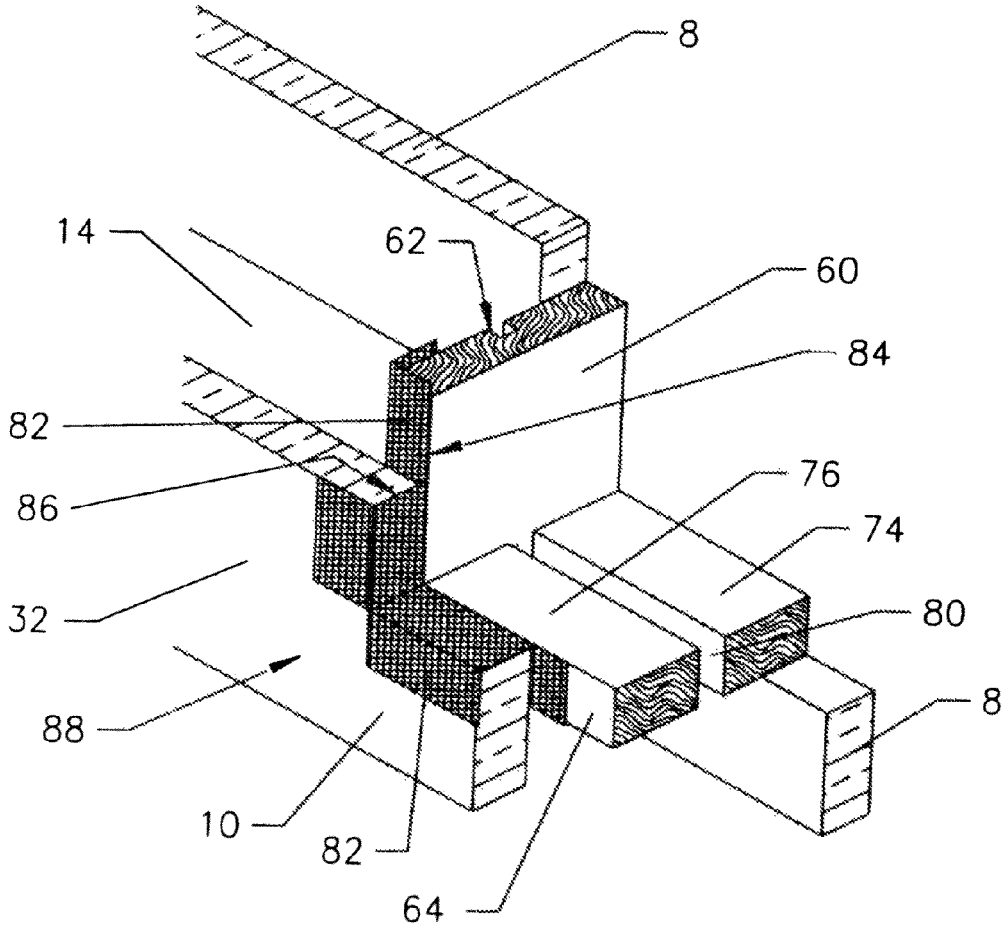
FIG. 6 is a partial perspective view of mesh installed around a frame for an opening in an ICF wall.

In FIG. 6, there is shown more detail of the bottom 72 of the frame 60. A gap 80 between the interior portion 74 and exterior portion 76 in the frame 60 allows for inspection of the space beneath the frame to ensure that the concrete placement is complete. The gap 80 is subsequently filled with foam (not shown). The same reference numerals are used in FIG. 6 as those used in the previous figures to describe those components that are identical. Mesh 82 is preferably made from plastic fibre and is sufficiently wide so that at least 2½ inches of the mesh can be embedded into the concrete that will ultimately be poured into the core 14. Mesh 82 is affixed to the outer surface 64 of the frame 60 and is wide enough to extend along a front 84 of the frame and an end 86 of the outside foam layer 10 partially around an outer surface 88 of the outside foam layer 10. When the exterior surface is completed with stucco (not shown in FIG. 6), a layer of mesh (not shown) is installed along the entire outer surface 88 of the outside foam layer 10. The stucco has a fire-rated base coat.

Figure 7:
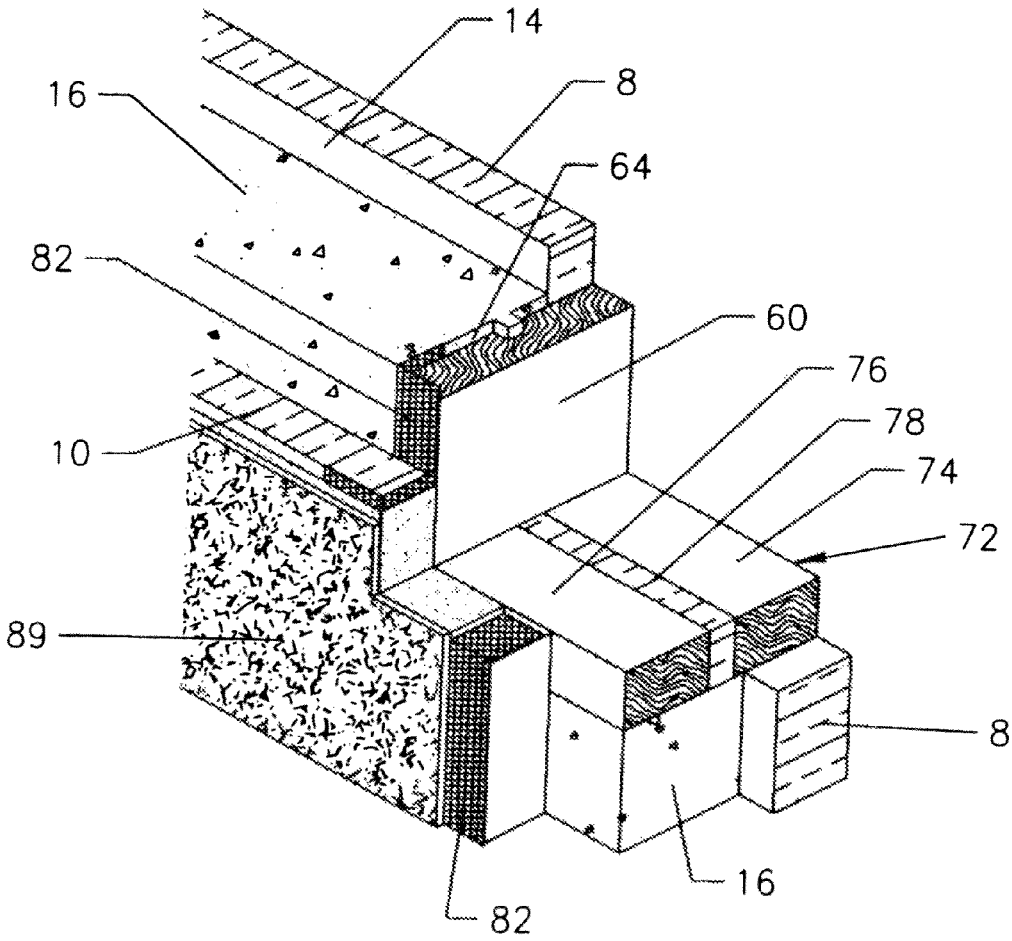
FIG. 7 is a partial perspective view of mesh installed around a frame of an opening where an exterior foam surface has been coated with stucco.

FIG. 7 shows a similar view to FIG. 6 except that additional finishing components are added to FIG. 7. The same reference numerals are used in FIG. 7 as those used in FIG. 6 and previous figures for those components that are identical. In FIG. 7, the concrete 16 has been poured into the core 14 and the groove 62 of the frame 60 is filled with concrete. Also, the minimum 2½ inch width of mesh on the outer surface 64 of the frame 60 is embedded in the concrete 16. The gap 80 (shown in FIG. 6) has been filled with foam 78 and the poured concrete fills the space beneath the frame 60. The mesh 82 is coated and embedded in an exterior base coat 89 as is the mesh on the outer surface 88 of the outside foam layer 10. After the base coat, stucco is added in the conventional manner.

Figure 8:
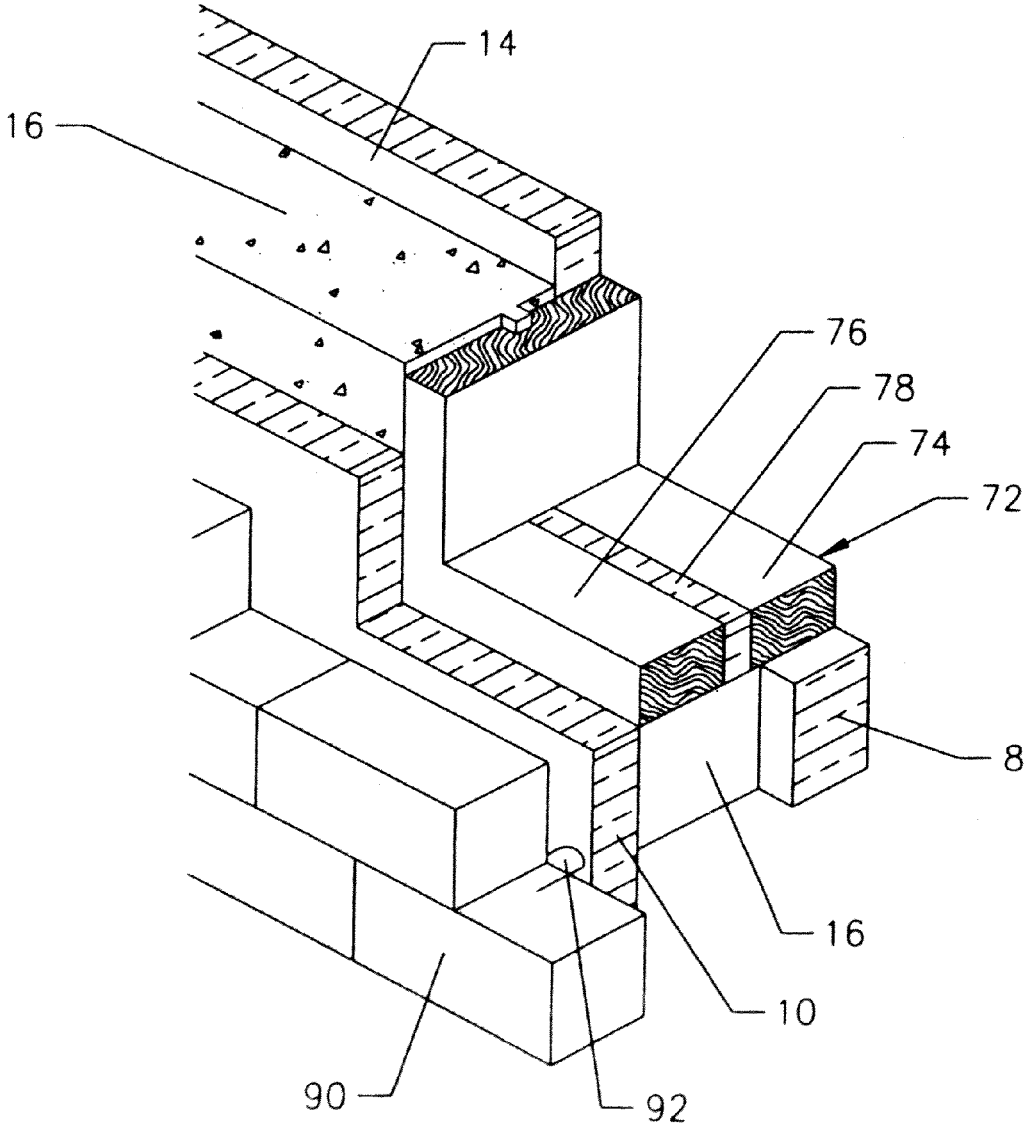
FIG. 8 is a partial perspective view of an ICF wall having a masonry exterior.

In FIG. 8, there is shown a perspective view of an ICF wall with a masonry exterior 90. The same reference numerals are used as those used for FIGS. 6 and 7 for those components that are identical. The masonry exterior 90 is conventional and held in place by anchors 92 preferably connected to the ties (not shown in FIG. 8) of the insulated concrete forms. The mesh shown in FIGS. 6 and 7 is not required with masonry exteriors. Some ICF buildings can be part masonry exterior and part non-masonry exterior. When a masonry exterior is used, a shelf or base (not shown) must be properly located to support the masonry wall.

Figure 9:
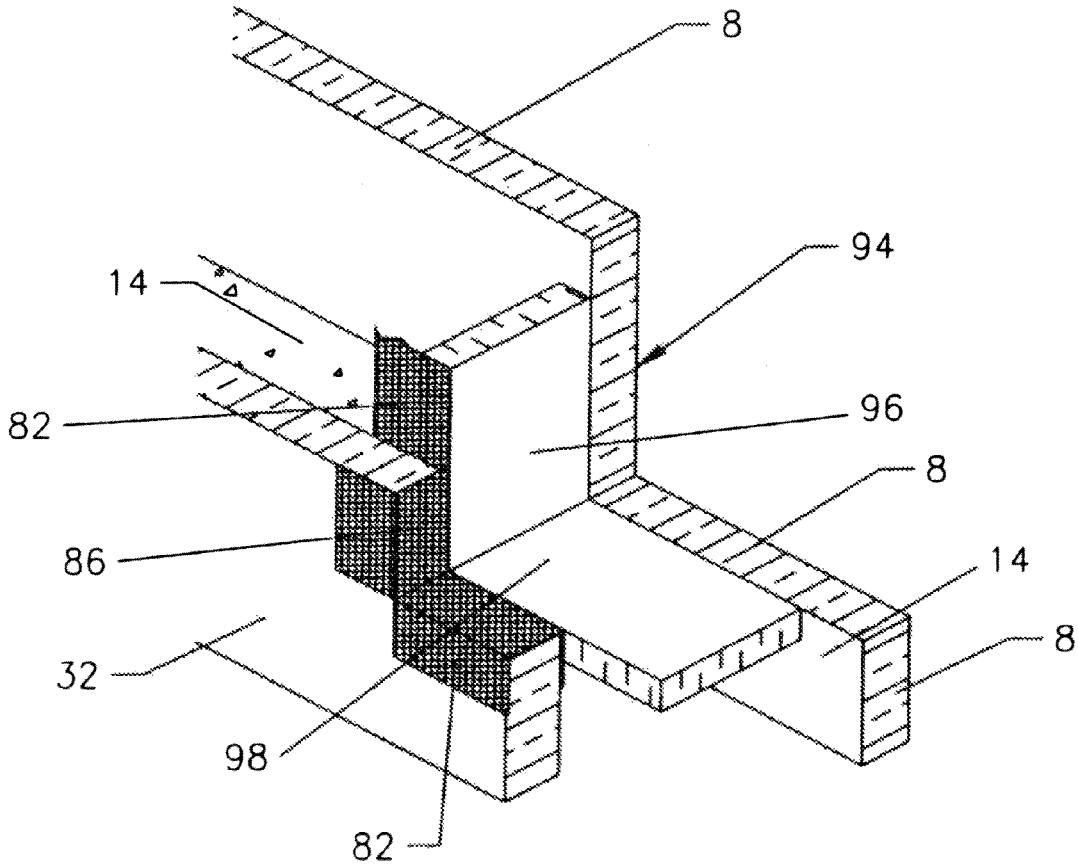
FIG. 9 is a partial perspective view of mesh installed around a foam frame of an opening.

In FIG. 9, there is shown a partial perspective view of an ICF wall with a window frame 94 (only partially shown) that is similar to the frame 60 shown in FIGS. 6 and 7, except that the frame 94 has a elongated members 96, 98 that are made from foam pieces rather than wood. The same reference numerals are used in FIG. 9 as those used in FIGS. 6 and 7 for those components that are identical. The foam pieces 96, 98 can be taken from foam that have been cut away from ICF forms in the building and would otherwise be wasted.

Figure 10:
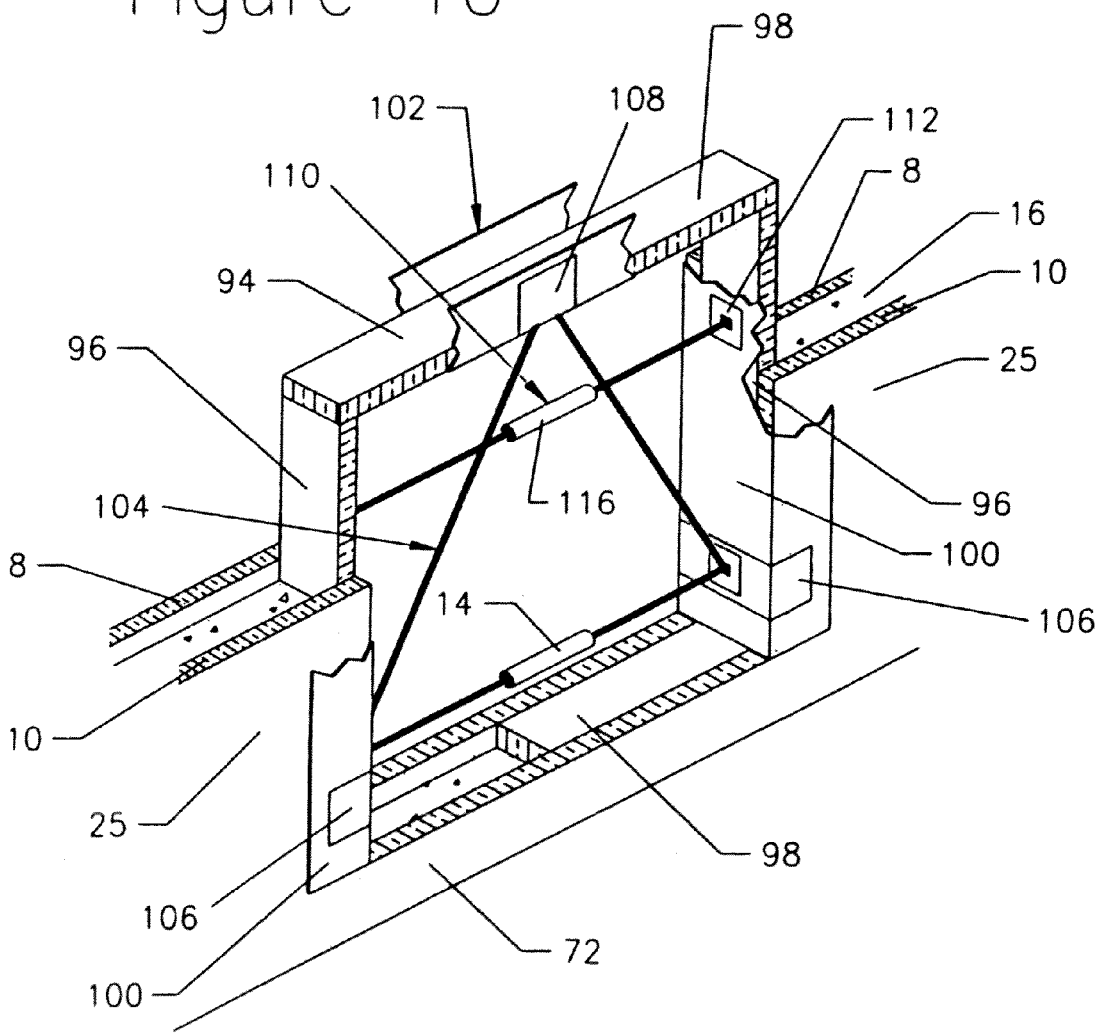
FIG. 10 is a partial perspective view of a window opening having a frame made of foam.

FIG. 10 is a partial perspective view of the frame 94 made up of two vertical foam pieces 96 and two horizontal foam pieces 98. Steel bucks 100 have a U-shaped cross section and are sized to fit around the two vertical foam pieces 96. A buck 102 is also U-shaped but is smaller than the bucks 100 as the buck 102 fits around the foam piece 98 at the top of the frame 94. The same reference numerals are used in FIG. 10 as those used in FIG. 5 for those components that are identical. The bucks 100, 102 are long enough to extend along the full length of the frame but are shown as being cut-off so as not to fully obscure the frame 94. A triangular brace 104 has U-shaped brackets 106 at the two sides and a U-shaped bracket 108 at the top, the brackets being sized to fit onto the bucks 100, 102 respectively. The triangular brace 104 can be adjustable in size or it can have a fixed size for use with a window frame of a particular size. A horizontal linear brace 110 has pads 112 at either end (only one of which is shown). The linear brace 112 can also be either adjustable or it can have a fixed size. The pads 112 rest against the bucks 100 on either side of the frame 94. The braces 104, 110 and the bucks 100, 102 are left in place until the concrete has been poured and has cured sufficiently so that it will not damage the frame 94 when the braces 104, 110 are removed. The braces 104, 110 have handles 114, 116 respectively thereon. The lower foam piece 98 is cut off to expose the poured concrete. The foam pieces 96, 98 are held in the ICF forms on the wall 25 by adhesive (not shown). The ICF forms are not individually identified and there are no ICF forms shown around the upper portion of the frame for ease of illustration. Since the foam pieces 96, 98 are held between the inner foam layer 8 and the outer foam layer 10 by adhesive, the peel and stick membrane 70 (used for the wood frame shown in FIG. 5) is not necessary when the foam frame 94 is used as the joints are already moisture resistant. The mesh 82 is embedded in the concrete 16 and extends past the foam pieces 96, 98 around the outer surface of the exterior foam layer 10 of the wall 25.

Figure 11:
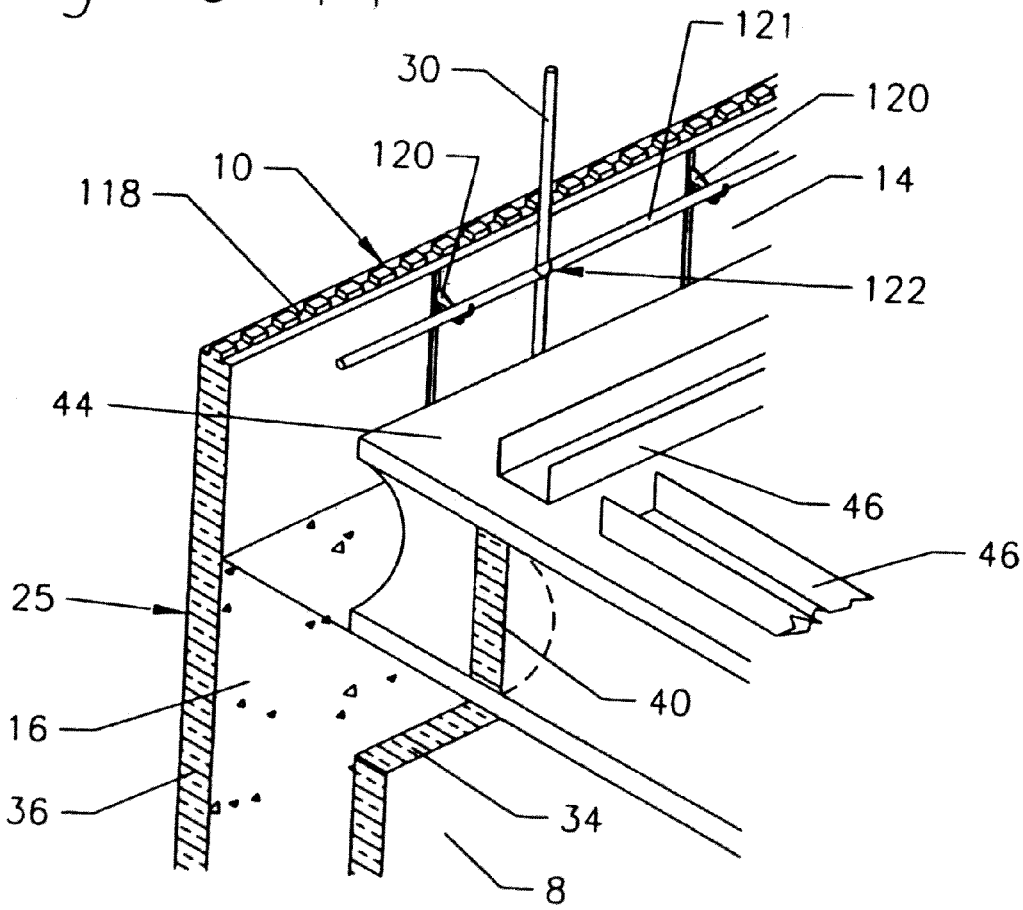
FIG. 11 is a partial perspective view of a support system for an exterior foam layer adjacent to a floor.

In FIG. 11, the same reference numerals are used as those used in FIG. 3 for those components that are identical. The cut forms 36 are the uppermost row of forms 118. Vertical reinforcing rods 30 (only one of which is shown in FIG. 11) extend from the core 14 above the uppermost row of forms 118. Ties 120 extend from the outer foam layer 10 toward the inner foam layer 8, but there is no inner foam layer corresponding to the outer foam layer 10 above the cut line 34. Rather than cutting the uppermost row of forms 118, non-symmetrical forms can be used for the uppermost row of forms of each storey where the inner foam layer is shorter than the outer foam layer by a distance approximately equal to the thickness of the floor 44. Horizontal reinforcing rods 121 are snapped into place within the ties 20 just inside the exterior foam layer 10 of the uppermost row of forms 118. At each vertical reinforcing rod 30, the horizontal reinforcing rod 121 is attached by a tie 122 to support and straighten the outside foam layer 10 of the uppermost row of forms 118. The ties 122 are adjusted to straighten and support the outside foam layer 10 by lengthening or shortening each tie as required to achieve the desired result. In this way, the horizontal reinforcing rods 121 are supported directly by that part of the wall 25 that has already been poured. There are various ways to straighten and support the outside foam layer of the uppermost row of forms 118, all of which directly or indirectly use the previously poured portion of the wall 25. In FIG. 3, adjustments 42 extend between the outside foam layer 10 and the floor 44. The floor 44 is in turn supported by the concrete wall that has previously been poured. In addition, supports can be installed between the outside foam layer or the ties to the outside foam layer and the concrete in that part of the wall that has been previously poured.

While the present invention can be used to improve any construction of all ICF buildings, it is preferably used for buildings exceeding three stories in height. ICF buildings constructed in accordance with the present invention will be constructed with a much narrower tolerance for straightness and squareness than previous ICF buildings. In addition, substantial cost savings can be achieved over the construction costs of conventional buildings. With buildings constructed in accordance with the present invention, there is no need to be on the outside of the building during the construction of the outside walls except for the masonry or stucco exterior. ICF buildings constructed in accordance with the present invention are fast and easy to construct relative to conventional buildings and relative to previous ICF buildings. Conventional high-rise buildings require a crane to be available on the building site almost from the start of construction until construction has been almost completely finished. With the method of construction of the present invention, it may be desirable to have a crane on site sometimes during construction, but a tower crane is generally not required and construction cost savings of 20 percent or higher can be achieved. Site size restrictions may make it necessary to use a tower crane for some ICF buildings. Also, no removable supplementary supports are required to support the two foam layers while the concrete is being formed resulting in a further saving.

While ICF forms are usually used for exterior walls, circumstances could arise where the forms are used for an interior wall or walls. One foam layer of each form is considered to be an inside layer and the other foam layer of each form is considered to be an outside layer when an interior wall is being constructed with ICF forms. Interior walls are within the scope of the claims.

The uppermost row of forms of each storey has an inside foam layer that is shorter than an outside foam layer for at least part of said row. Since there is no corresponding inside foam layer, the outside foam layer must be straightened and supported. Otherwise, the outside foam layer will not remain straight and/or will move outward as the fresh concrete is poured. The outside foam layer is said to be an unopposed outside foam layer as there is no corresponding inside foam layer directly opposite the outside foam layer. The outside foam layer is straightened and supported by supports that are directly or indirectly anchored in that part of the concrete wall that has previously been poured. The supports extend inward from the outside foam layer and are embedded in the concrete wall when it is poured beyond a level of the outside foam layer. The supports can be anchored in a floor or they can be anchored to reinforcing rods in the concrete wall or they can be anchored directly into the concrete wall. The supports can each comprise more than one component. In many buildings, the uppermost row of forms of each storey will have an unopposed outside foam layer. However, where balconies or other external structures are added to the outside portion of the vertical wall at the uppermost row of forms for each storey, the portion of the uppermost row of forms where an external structure is added will not have an unopposed foam layer as both the inside foam layer and outside foam layer will be substantially at the same height in order to accommodate the external structure. In that portion of the vertical wall where there is no external structure, there will be an unopposed outside foam layer in the uppermost row of forms for each storey. The supports will be installed for the unopposed outside foam layer before the concrete is poured against that outside foam layer.

Preferably, the mesh is embedded in concrete when the concrete is poured and extends along an exterior of the outside foam layer along the bottom of a bottom row of forms of each building and along a top of the top row of forms of each building and along any border or edge of the insulated concrete form wall. The guides are preferably vertically aligned with one another using lasers as each storey is constructed.

I claim:

1. A method of constructing a building having multiple storeys using insulated concrete forms, said forms having two layers of foam spaced apart from one another by ties to define a core, each of said forms having an inside foam layer and an outside foam layer, said forms being stackable to form a vertical wall, said method comprising stacking said forms for an insulated concrete form storey with openings for any windows and doors, with an uppermost row of forms for each storey having an inside foam layer that is shorter than an outside foam layer by a distance that is substantially equal to a thickness of a floor to be installed at a top of said inside foam layer, installing reinforcing rods and pouring fresh concrete between and in contact with said inside foam layer and said outside foam layer to fill said core with said fresh concrete substantially up to said top of said inside foam layer of said uppermost row of forms, allowing said fresh concrete to cure sufficiently to support the weight of said floor to enable said floor to be installed, installing supports for said outside foam layer of said uppermost row of forms for each storey to straighten and support said outside foam layer when fresh concrete is being poured against said outside foam layer of said uppermost row of forms, installing said floor on said sufficiently cured concrete and repeating said method for each subsequent storey, at least partially imbedding said supports in said concrete and locating said supports to leave said supports in place when said vertical wall has been completed.

2. A method as claimed in claim 1 wherein said forms are one or more selected from the group of straight forms, curved forms, corner forms, angled forms, special forms, components for assembling forms and non-symmetrical forms and said method includes the steps of choosing the appropriate forms to form said vertical wall and cutting forms as required before or after placing said forms in said wall.

3. A method as claimed in claim 2 including the steps of installing said supports by placing horizontal reinforcing rods just inside said outside foam layer of said uppermost row of forms for each storey, securing said horizontal reinforcing rods to said uppermost row of forms and to said vertical wall that has been poured.

4. A method as claimed in claim 3 including the steps of securing said horizontal reinforcing rods to said vertical wall by tying said horizontal reinforcing rods to reinforcing rods extending out of said concrete in said core that has previously cured.

5. A method as claimed in claim 2 including the steps of installing said supports by installing adjustments to anchor said outside foam layer to a portion of said concrete in said core that has previously been poured.

6. A method as claimed in claim 2 including the steps of installing said supports by installing adjustments between said ties for said outside foam layer and said concrete that has been previously poured to form said wall, and adjusting said adjustments to support and straighten said outside foam layer adjacent to each floor.

7. A method of constructing a multi-storey building having at least one vertical wall made of insulated concrete forms, said forms each having two layers of foam spaced apart from one another by ties to define a core, said building to have multiple floors with ends that are embedded in said at least one vertical wall, said core to be filled with concrete except for openings for windows and doors, an uppermost row of forms of each storey having at least part of an outside foam layer with no corresponding inside foam layer to allow each floor to be partially embedded into said wall on said concrete, said method comprising stacking said forms to form a vertical wall for one storey at a time with suitable openings for windows and doors, installing reinforcing rods, pouring concrete between and in contact with said inside foam layer and said outside foam layer to fill said core with said concrete substantially up to a top of said inside foam layer of said uppermost row of forms, installing supports that are affixed directly or indirectly to a portion of said concrete wall that has previously been poured and to said at least part of an outside foam layer with no corresponding inside foam layer to straighten and support said at least part of an outside foam layer of said uppermost row of forms, allowing said concrete to cure sufficiently to support the weight of one of said floors, installing said one of said floors on said cured concrete, and installing said supports by installing adjustments between said at least part of an outside foam layer with no corresponding inside foam layer and said one of said floors and adjusting said adjustments to support and straighten said outside foam layer at a level of said wall with no corresponding inside foam layer.

8. A method as claimed in claim 7 including the step of continuing said method until said building is greater than three storeys.

9. A method of constructing a multi-storey building having at least one vertical wall made of insulated concrete forms, said method comprising stacking the forms on a base to form at least one vertical wall one storey at a time with suitable openings therein for windows and doors, installing reinforcing rods, filling a core of said insulated concrete forms with concrete one storey at a time, allowing said concrete to cure sufficiently to support a weight of a floor, installing a said floor for a next storey at an upper level of said at least one vertical wall for each storey on said cured concrete so that an end of said floor can be supported by said concrete and embedded in said wall, installing supports for an outside foam layer of said forms adjacent to said floor of an uppermost row of forms for each storey to straighten and support said outside foam layer and connecting said supports directly or indirectly to a portion of said concrete that has been previously poured and said outside foam layer at a level of said wall with no corresponding inside foam layer, and repeating said method to construct additional storeys and installing a roof on an uppermost storey, at least partially embedding said supports in said concrete.

10. A method as claimed in claim 9 including the steps of installing an alignment guide on an upper surface of each floor for each subsequent storey, said guide being aligned with an inside foam layer of any previous storeys and inserting an inside foam layer of a first row of forms for each storey in said guide for each storey.

11. A method as claimed in claim 9 wherein said building is to have a stucco exterior and there are frames around an outside of said windows and doors with retention means extending beyond an outer surface of each frame, said retention means becoming embedded in said concrete when said concrete is poured, said retention means extending from an outside of said frame around said outside foam layer and partially along a front of said outside foam layer, embedding an outer portion of said retention means in a stucco mixture when installing stucco on said building.

12. A method of constructing a multi-storey building having at least one vertical wall made of insulated concrete forms, said forms having an inside foam layer and an outside foam layer spaced apart from one another by a pre-determined distance to form a core, said method comprising constructing a base, stacking said forms on said base and on one another to form said vertical wall one storey at a time with openings therein for any windows and doors, installing reinforcing rods and locating a channel in said inside foam layer at each storey to receive an end of each floor that is to be embedded in said vertical wall, filling said core with concrete one storey at a time substantially up to a level of said channel, allowing said concrete to cure, installing supports between a portion of said concrete that is previously poured and an outside foam layer adjacent to said channel at a level of said wall with no corresponding inside foam layer, adjusting said supports to straighten and support said outside foam layer, installing said floor on said cured concrete and repeating said method for further storeys and installing a roof on an uppermost storey.

13. A method of constructing a building having multiple storeys using insulated concrete forms having two parallel foam layers separated by ties that are embedded in the foam layers to define a core for receiving poured concrete, said forms being stackable to form a wall or walls, said method comprising: (a) constructing a base for said walls; (b) stacking forms on said base to form said wall, one storey at a time with suitable openings for doors and windows; (c) locating a channel in said inside foam layer at an uppermost level of forms for each storey to allow a floor to be embedded into said wall; (d) installing frames for said windows and doors as said forms are stacked; (e) installing reinforcing rods in said wall; (f) filling said core with fresh concrete up to said channel just below a lower surface of a floor to be installed; (g) allowing said concrete to cure sufficiently to support a weight of said floor to allow said floor to be installed; (h) installing a plurality of supports along said channel between said outside foam layer at said channel and directly or indirectly to a part of said concrete previously poured, adjusting said supports to straighten and support said outside foam layer at a level of said wall with no corresponding inside foam layer; (i) installing said floor on said cured concrete and stacking forms on said uppermost row of forms and on said floor to form a subsequent storey with suitable openings for doors and windows while installing frames for any doors and windows; (j) repeating steps (c) to (i) for each subsequent storey except for an uppermost storey; and constructing said uppermost storey and installing a roof on said uppermost storey.

14. A method of constructing a building having multiple stories using a plurality of insulated concrete forms, each of said forms having two layers of foam spaced apart from one another by a pre-determined distance to define a core, said two layers being an inside layer and outside layer, said building having a base, said forms being stackable to form a wall, said method comprising constructing said building in stages on said base, arranging said forms on said base and stacking said forms to form a vertical wall for a first insulated concrete form storey with openings for any windows and doors, cutting away said inside layer of each form that is located just beneath a floor for a second storey thereby creating cut forms, installing reinforcing rods and filling said core with fresh concrete to a level of said cut away inside layer, removing voids and allowing said fresh concrete to cure sufficiently to support the weight of a floor, installing said floor for said second storey on said cured concrete just above a cut line of said cut forms in such a manner that said floor can be partially embedded into said vertical wall, installing a plurality of adjustments between said floor for said second storey and said outside foam layer of said cut forms to allow said outside foam layer to be straightened, adjusting said adjustments to straighten said outside foam layer at a level of said wall with no corresponding inside foam layer, installing an alignment guide on an upper surface of said floor of said second storey in a position directly above an interior surface of forms located beneath said floor, stacking forms on said cut forms and on said guide to form a subsequent storey with suitable openings for any doors and windows and installing reinforcing rods, repeating said method described for said first insulated concrete form storey for subsequent stories and installing a roof on an uppermost storey.

15. A method as claimed in claim 14 wherein each window and door has a frame, said method including the steps of installing retention means in an exterior surface of each frame in such a manner that the retention means are embedded in concrete when said concrete is poured, installing a mesh on an exterior surface of each frame in such a manner that said mesh is embedded in concrete when said concrete is poured, said mesh being wide enough to extend along an exterior of said frame, around said exterior foam layer and partially along a front of said outside foam layer, installing each frame containing retention means and said mesh before said forms are stacked around each frame.

16. A method as claimed in claim 14 wherein said floors that are embedded in said insulated concrete form walls are made of precast concrete floor slabs, said method including the steps of installing said reinforcing rods in passages located within said floor slabs so that said reinforcing rods extend into said wall.

17. A method as claimed in claim 14 including the step of filling gaps located between said forms on an interior surface with foam.

18. A method of constructing a building having multiple storeys using insulated concrete forms, said forms having two opposing layers of foam spaced apart from one another by ties to define a core, each of said forms having an inside foam layer and an outside foam layer, said forms being stackable to form a vertical wall with at least part of an uppermost row of forms of each storey having an unopposed outside foam layers said unopposed outside foam layer being at a higher level than an inside foam layer, said method comprising stacking said forms for an insulated concrete form storey with openings for any windows and doors, with at least part of said uppermost row of forms for each storey having an unopposed outside foam layer with said top being higher than a top of said inside foam layer for each storey, installing reinforcing rods and filling said core with fresh concrete substantially up to said top of said inside foam layer of said uppermost row of forms, allowing said concrete to cure sufficiently to support a weight of said floor to enable said floor to be installed on said cured concrete, installing supports to straighten and support said unopposed outside foam layer, said supports extending inward from said unopposed outside foam layer at a level of said unopposed outside foam layer with no corresponding inside foam layer and being anchored directly or indirectly in said wall as previously formed, installing said floor on said sufficiently cured concrete and repeating said method for each subsequent storey, at least partially embedding said supports in said concrete and locating said supports to leave said supports in place when said vertical wall has been completed.

* * * * *